United States Patent [19]

Loutaty et al.

[11] Patent Number: 4,882,035

[45] Date of Patent: Nov. 21, 1989

[54] PROCESS FOR IMPROVING THE DESHAFTING OF A HEAVY HYDROCARBON FEEDSTOCK

[75] Inventors: Roben Loutaty, Le Havre; Pierre Maroy, Versailles; Gilles Trinquet, Le Havre, all of France

[73] Assignee: Compagnie de Raffinage et de Distribution Total France, France

[21] Appl. No.: 84,637

[22] Filed: Aug. 12, 1987

[30] Foreign Application Priority Data

Aug. 12, 1986 [FR] France ..... 86 11638

[51] Int. Cl.[4] ..... C10C 1/18

[52] U.S. Cl. ..... 208/45; 208/39; 208/309

[58] Field of Search ..... 208/45, 309, 39, 86

[56] References Cited

U.S. PATENT DOCUMENTS

| | | | |
|---|---|---|---|
| 2,303,023 | 11/1942 | Cier | 208/45 |
| 2,871,180 | 1/1959 | Lowman, Jr. et al. | 208/45 |
| 3,228,870 | 1/1966 | Pitchford | 208/309 |
| 3,811,844 | 5/1984 | Dunmyer, Jr. | 422/257 |
| 4,315,815 | 2/1982 | Gearhart | 208/309 |
| 4,508,597 | 4/1985 | Roach | 208/356 |
| 4,528,068 | 7/1985 | Fiocco et al. | 208/86 |
| 4,572,781 | 2/1986 | Krasuk et al. | 208/45 |
| 4,666,562 | 5/1987 | Nelson | 208/349 |
| 4,686,028 | 8/1987 | Van Driesen et al. | 208/86 |

FOREIGN PATENT DOCUMENTS

| | | | |
|---|---|---|---|
| 0716703 | 12/1931 | France | 422/257 |
| 2218920 | 9/1974 | France | 422/257 |
| 002162B | 1/1983 | Japan | 208/309 |
| 03650 | 1/1932 | United Kingdom | 422/257 |

*Primary Examiner*—Anthony McFarlane

*Attorney, Agent, or Firm*—A. Thomas S. Safford

[57] ABSTRACT

A process for improving the deasphalting of a heavy hydrocarbon feedstock with a solvent by subjecting the feedstock to shearing alternatively after and/or before the addition of at least a portion of the solvent to the feedstock is disclosed. Alternative means for effecting the shearing and desired ranges of shear are also disclosed.

21 Claims, 1 Drawing Sheet

PROCESS FOR IMPROVING THE DESHAFTING OF A HEAVY HYDROCARBON FEEDSTOCK

The present invention relates to a process for deasphalting a heavy hydrocarbon feedstock.

A heavy hydrocarbon feedstock within the meaning of the present invention is a feedstock having a density at 15° C. greater than about 930 kg/m$^3$ and composed essentially of hydrocarbons but containing also other chemical compounds which have, in addition to carbon and hydrogen atoms, heteroatoms such as oxygen, nitrogen and sulfur, and metals such as vanadium or nickel.

This feedstock may consist, in particular, of a crude petroleum or of a heavy oil having the aforesaid density.

The feedstock may also come from the fractionation or treatment of crude petroleum, of a heavy oil, of oil shales or even of coal. Thus it may be the residuum from vacuum distillation or the residuum from atmospheric distillation of the starting products cited above or, for example, products obtained by the thermal treatment of these starting products or their distillation residua.

BACKGROUND OF THE INVENTION

The trend in recent years has been to seek to upgrade high-density hydrocarbonaceous products more and more, which was not the case before. The need to upgrade heavy products has become more pressing since it is anticipated that the demand for light products such as motor fuels will increase at a relatively faster pace than the demand for heavier products, such as fuel oils.

The heaviest portion of heavy hydrocarbon feedstocks consists of a mixture of an oil phase and an asphaltic phase.

The asphaltic phase is the phase which precipitates upon the addition of a hydrocarbon with a low boiling point (for example, propane, butane, pentane, hexane, or heptane), the oil phase being soluble in said hydrocarbon.

The oil phase, that is, the light phase, is economically more worthwhile than the asphaltic phase. It fact, it may be used as a catalytic cracking feedstock that will yield light products. It may also serve as a feedstock for the production of lubricating-oil bases. These products are more valuable than the fuels and bitumens obtained from the asphaltic phase.

As has been pointed out above, heavy hydrocarbon feedstocks contain compounds which have, in addition to hydrogen and carbon atoms, heteroatoms such as oxygen, nitrogen and sulfur as well as metals. Some of these compounds, and particularly those containing metals, are present especially in the asphaltic phase.

Two groups are customarily distinguished among the compounds which make up the asphaltic phase: the resins and the asphaltenes. Both the asphaltenes and the resins have polycyclic aromatic structures. Apart from aromatic rings, thiophene and pyridine rings are present. However, the resins have less-condensed structures than the asphaltenes and lower molecular weights.

The name "asphaltenes" is generally applied to compounds which are precipitated by the addition to the feedstock of a saturated aliphatic hydrocarbon having from 5 to 7 carbon atoms, such as pentane, hexane, or heptane. Under French standard AFNOR NFT 60-115, the asphaltene content of a product thus is determined by precipitation with normal heptane upon boiling.

The resins precipitate at the same time as the asphaltenes when a hydrocarbon with a lower boiling point, for example, propane, is used. In fact, this is a conventional differentiation, and it is obvious that when a given hydrocarbon is employed at a given temperature to treat a feedstock, precipitation of asphaltene-type compounds can be obtained if the hydrocarbon and the temperature are appropriate. If the feedstock freed from the asphaltenes is then treated with the same hydrocarbon at a higher temperature, precipitation of the resins is obtained.

In the well-known deasphalting process, the oil phase and the asphaltic phase are separated by an operation which consists in extracting the oil phase from a hydrocarbon feedstock by means of a substance known to those skilled in the art as a solvent. The solvent is both a solvent for the oil phase and a precipitant for the asphaltic phase. Hereinafter it will be referred to simply as a solvent.

The solvent may be selected from the group consisting of:

saturated or unsaturated aliphatic hydrocarbons having from 2 to 8 carbon atoms, alone or in admixture;

mixtures of hydrocarbons, known as distillates, with molecular weights close to those of the hydrocarbons having from 2 to 8 carbon atoms; and mixtures of all of the aforesaid hydrocarbons.

Deasphalting may be carried out in a single stage, in which case an oil phase and an asphaltic phase are obtained, the latter containing both the asphaltenes and the resins. It may also be carried out in two stages, using two different solvents and/or different operating conditions in the two stages. In the two-stage process, the oil phase, the resins and the asphaltenes are obtained separately. (See, for example, French patent application No. 86 06994, filed on May 15, 1986, in the name of the Applicant; and correspond-U.S. patent application Ser. No. 050,912 filed May 15, 1987).

As mentioned above, it is the oil phase that is more worthwhile economically. In a deasphalting process, whether single- or two-stage, it is therefore advisable to endeavor to obtain a maximum yield of the oil phase. Of course, this striving for a maximum oil-phase yield should not be at the expense of the characteristics of the oil phase.

BRIEF SUMMARY OF THE INVENTION

The present invention thus is directed to increasing in a deasphalting process the yield of the oil phase while preserving the characteristics of the oil phase which are desirable for the contemplated use. For example, for its use as a catalytic cracking feedstock, a Conradson residue (determined in conformity with standard AFNOR NFT 60-116) of less than 10 weight percent is desirable.

To this end, the invention has as a preferred embodiment a process for deasphalting a heavy hydrocarbon feedstock by means of a solvent, said process being characterized in that the feedstock is subjected to shearing, optionally before and/or after the addition of at least a portion of the solvent.

For the purposes of the present invention, shearing means the application of high stress to the diluted or undiluted feedstock.

The shearing action may be produced in particular by the forced passage of the feedstock, which optionally contains at least a portion of the solvent, through a restriction, a convergent die, a gap between two parts, one of which is moving relative to the other, a pipe of smaller cross-sectional area than the feed pipe for the feedstock, or any equivalent contrivance.

The shearing action may also be produced by the use of a turbine or of any other agitating means, optionally in the deasphalting tower.

In the case of the passage of the feedstock through a gap bounded by a stationary part and a coaxial part rotating within the stationary part, the shearing action expressed as a rate is given by the ratio du/dx, where du is the velocity difference between the walls of the gap, and dx the distance separating the parts bounding the gap. This shearing may then be at a rate ranging from $10^3$ to $10^6$ $s^{-1}$ and preferably ranges from $10^4$ to $2 \cdot 10^5$ $s^{-1}$, where s is time in seconds.

The result of the shearing action is surprising since one skilled in the art would be inclined to think that shear would cause the asphaltenes to be dispersed rather than precipitated. It is well known, for example, that to obtain an emulsion of fine water droplets in an oil it is advisable to agitate the oil/water mixture vigorously, in other words, to produce strong shearing action.

The deasphalting operation which follows shearing or is concurrent with it may be carried out in one or two stages.

In the former case, an oil phase and an asphaltic phase are obtained, and in the latter case, an oil phase, a resin phase and an asphaltene phase.

The solvent used in the extraction stage or stages may be selected from the group consisting of saturated or unsaturated aliphatic hydrocarbons having from 2 to 8 carbon atoms, alone or in admixture;

mixtures of hydrocarbons, known as distillates, with molecular weights close to those of the hydrocarbons having from 2 to 8 carbon atoms;

mixtures of all of the aforesaid hydrocarbons; and other chemical compounds which have, in addition to carbon and hydrogen atoms, heteroatoms such as oxygen, for example, alcohols and phenols, alone or in admixture with the aforesaid hydrocarbons.

The operating conditions in the deasphalting stages may be as follows:

Pressure ranging from $20 \cdot 10^5$ to $1 \cdot 10^7$ pascals abs.

Temperature ranging from 30° to 300° C.

Mass ratio of solvent to feedstock ranging from 1 to 10.

These conditions will vary, of course, depending in particular on the nature of the feedstock and on the nature of the solvents used.

A better understanding of the invention will be provided by the detailed description which follows, with reference to the accompanying drawing, which is non-limitative.

DETAILED DESCRIPTION

Figure 1:
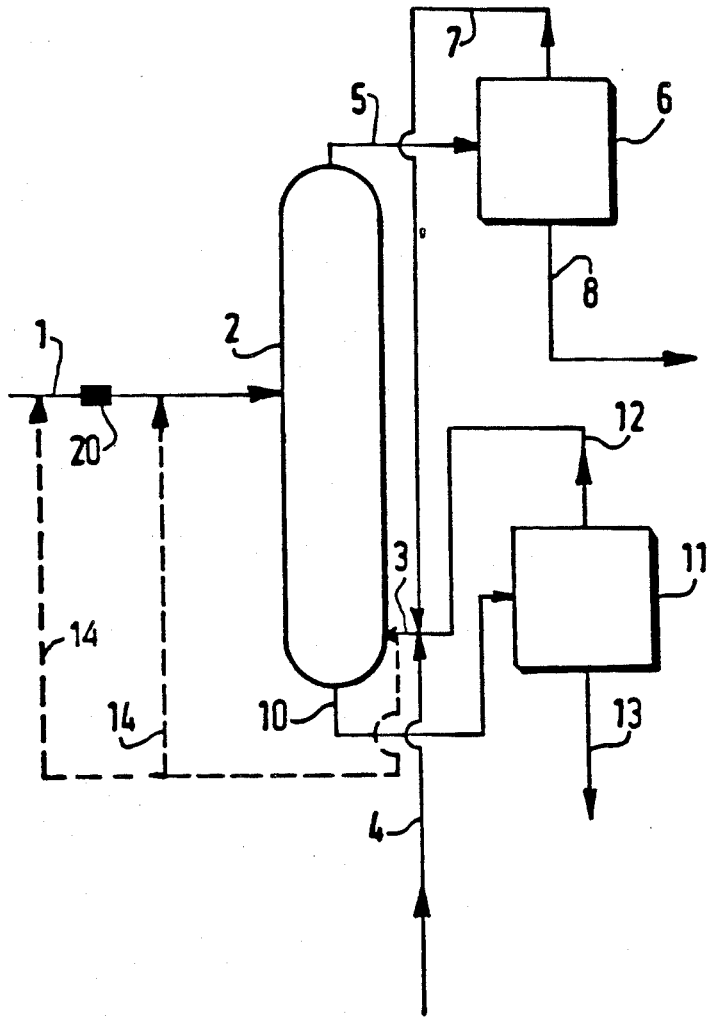
FIG. 1 diagrammatically shows as a preferred embodiment a deasphalting unit including a shearing installation.

In this embodiment of the invention, the heavy hydrocarbon feedstock to be deasphalted, for example, an oil having a density at 15° C. greater than 930 kg/m³, is introduced through line 1 into the midsection of a liquid-liquid extractor 2.

In the extractor 2, the oil phase is extracted from the feedstock by means of a solvent introduced into the extractor through line 3. The solvent may be, in particular, a saturated or unsaturated aliphatic hydrocarbon having from 2 to 8 carbon atoms, and preferably from 3 to 5 carbon atoms, or mixtures of hydrocarbons, known as distillates, having from 2 to 8 carbon atoms, or mixtures of all of the aforesaid hydrocarbons.

The starting solvent of the unit comes from a source external to the unit through line 4. The solvent losses may be compensated by means of an external makeup supplied through line 4.

The pressure in the interior of the extractor 2 may range from $20 \cdot 10^5$ to $1 \cdot 10^7$ pascals abs, the temperature from 30° to 300° C., and the mass ratio of solvent to feedstock from 1 to 10.

At the top of the extractor 2, through line 5, the oil phase in solution in the solvent is recovered. This mixture is piped through line 5 to a fractionating section 6. For simplicity, this section is not shown in detail, but it generally comprises a regulator controlling a pressure drop, as well as evaporators.

At the outlet of section 6, solvent is recovered through line 7 and recycled to the extractor 2 through line 3, and the oil phase is withdrawn through line 8.

At the bottom of the extractor 2, the precipitated asphaltic phase as well as solvent are withdrawn. This mixture is conducted through line 10 to a fractionating section 11, which generally comprises a furnace or an exchanger with a hot fluid, an evaporator, and a steam stripping column.

At the outlet of section 11, solvent is recovered through line 12 and recycled to the extractor 2 through line 3, and the asphaltic phase is withdrawn through line 13.

A portion of the solvent from line 3 may be piped to line 1 through line 14 to predilute the feedstock, if desired.

In accordance with the invention, at least one restriction may be located at 20 in line 1 to induce shear in the feedstock. (There might be several such restrictions in parallel, depending on the flow rate of the feedstock.) This restriction could also be located downstream or upstream of the intersection of lines 1 and 14, ahead of the deasphalting tower 2.

In addition to or in place of the device 20, an agitating means such as a turbine may be provided in tower 2.

The examples which follow will illustrate how the invention is carried out as well as its advantages.

EXAMPLE 1

This example relates to deasphalting tests run with a vacuum-distillation residuum of the atmospheric-distillation residuum of a Safaniya crude petroleum with and without prior shearing of the residuum.

The characteristics of this charge stock are as follows:

| | |
|---|---|
| Density at 15° C.: (Determined in conformity with standard AFNOR NFT 60-101) | 1042 kg/m³ |
| Viscosity at 100° C.: (Determined in conformity with standard AFNOR NFT 60-200) | 6250 mm²/s |
| Conradson residue: (Determined in conformity with standard AFNOR NFT 60-116) | 22.9 wt. % |
| Asphaltene content: (Determined in conformity with standard AFNOR NFT 60-115) | 15.1 wt. % |
| Sulfur content: | 5.46 wt. % |

-continued

| | |
|---|---|
| (Determined by x-ray fluorescence) | |
| Nickel content: | 45 ppm |
| (Determined by x-ray fluorescence) | |
| Vanadium content: | 149 ppm |
| (Determined by x-ray fluorescence) | |

This feedstock is subjected to:

deasphalting control tests T1 and T2 without prior shearing of the charge stock, and tests A11, A12 and A2 in accordance with the invention after prior shearing of the feedstock and without prior solvent addition.

The deasphalting solvent used in all tests is a solvent having the following composition (in percent by volume):

| | |
|---|---|
| Propane | 0.82 |
| Isobutane | 43.99 |
| n-Butane | 23.01 |
| n-Butene-1 | 8.08 |
| Isobutene | 9.17 |
| cis-Butene-2 | 9.16 |
| trans-Butene-2 | 5.70 |
| Isopentane | 0.07 |

TABLE 1-continued

| Test | Temperature °C. | Pressure $10^5$ pascals abs | Mass ratio solvent to feedstock | Nature of prior shearing |
|---|---|---|---|---|
| | | | | utes. |
| A12 | 70 | 40 | 4 | Machine: Emulsifier. Gap: 1 mm. Speed of rotation: 7000 rpm. Temperature: 150° C. No recycling. Single pass. Very short time. |
| T2 | 70 | 40 | 6 | No shearing. |
| A2 | 70 | 40 | 6 | Machine: Emulsifier. Gap: 0.35 mm. Speed of rotation: 7000 rpm. Temperature: 130° C. Recycling time: 10 minutes. |

At the end of these tests and after separation of the solvent, an oil phase and an asphaltic phase are obtained. The yields obtained and the characteristics of these phases are determined. They are presented in Table 2 which follows.

TABLE 2

| Test | | T1 Oil phase | T1 Asphaltic phase | A11 Oil phase | A11 Asphaltic phase | A12 Oil phase | A12 Asphaltic phase |
|---|---|---|---|---|---|---|---|
| Yield, wt. % | | 46.2 | 53.8 | 49.6 | 50.4 | 50 | 50 |
| Density at 15° C., kg/m$^3$ | (1) | 967.3 | | 966.7 | | 965.2 | |
| Index of refraction at 60° C. | | 1.5290 | | 1.5296 | | 1.5288 | |
| Softening point, °C. | (3) | | 122.5 | | 119 | | 122 |
| Viscosity at 100° C., mm$^2$/s | (4) | 108.9 | | 111.7 | | 100.7 | |
| Conradson residue, wt. % | (5) | 6.4 | 37.5 | 6.05 | 37.1 | 6.6 | 36 |
| Asphaltene content, wt. % | (6) | 0.05 | 31.6 | 0.05 | 29.6 | 0.08 | 34.5 |
| Sulfur content, wt. % | (7) | 3.71 | 7.58 | 3.70 | 6.54 | 3.75 | 7.14 |
| Nickel content, ppm | (7) | 4 | 92 | 3 | 93 | 3 | 87 |
| Vanadium content, ppm | (7) | 6 | 296 | 8 | 260 | 7 | 269 |

| Test | | T2 Oil phase | T2 Asphaltic phase | A2 Oil phase | A2 Asphaltic phase |
|---|---|---|---|---|---|
| Yield, wt. % | | 62.5 | 37.5 | 66.6 | 33.4 |
| Density at 15° C., kg/m$^3$ | (1) | 969.6 | | 968.5 | |
| Index of refraction at 60° C. | | 1.5305 | | 1.5299 | |
| Softening point, °C. | (3) | | | | |
| Viscosity at 100° C., mm$^2$/s | (4) | 121.3 | | 114.5 | |
| Conradson residue, wt. % | (5) | 6.7 | 37.4 | 6.6 | 36 |
| Asphaltene content, wt. % | (6) | 0.045 | 32.3 | 0.13 | 31.7 |
| Sulfur content, wt. % | (7) | 3.76 | 7.15 | 3.82 | 6.76 |
| Nickel content, ppm | (7) | 3 | 90 | 3 | 98 |
| Vanadium content, ppm | (7) | 6 | 285 | 7 | 271 |

(1) In conformity with standard AFNOR NFT 60-101
(3) In conformity with standard AFNOR NFT 66-008
(4) In conformity with standard AFNOR NFT 60-100
(5) In conformity with standard AFNOR NFT 60-116
(6) In conformity with standard AFNOR NFT 60-115
(7) Determined by x-ray fluorescene The conditions of the tests are given in Table 1 which follows.

TABLE 1

| Test | Temperature °C. | Pressure $10^5$ pascals abs | Mass ratio solvent to feedstock | Nature of prior shearing |
|---|---|---|---|---|
| T1 | 70 | 40 | 4 | No shearing |
| A11 | 70 | 40 | 4 | Machine: Emulsifier. Gap: 1 mm. Speed of rotation: 7000 rpm. Temperature: 150° C. Recycling time: 2 min- |

In discussing Example 1 (including Tables 1 and 2), the published French priority application (No. 86.11638 filed Aug. 12, 1986 and from which priority was claimed in the original application papers in this case) made the following observations:

From these results, it can be seen that with identical operating conditions, better yields of oil of a substantially similar quality are obtained by the process of the invention.

For example, if one compares tests T2 and A2, the oil yield increases from 62.5% to 66.6%, which means an increase of 4.1%. It can be seen, also, that the quality of the resulting oil is almost identical for the two tests:

Conradson residue (wt %): 6.5 and 6.6,

Viscosity at 100° C. ($mm^2/s$): 119.3 [sic., actually 121.3 in Table 2] and 114.5.

It should also be noted that the advantageous effect of the shearing subsists even if the deasphalting step is not conducted immediately after the shearing step.

EXAMPLE 2

This example relates to deasphalting tests run with two feedstocks $C_1$ and $C_2$, with and without prior shearing of the feedstocks. When it is effected, shearing takes place in the presence of solvent.

Feedstock $C_1$ identical to that used in Example 1 and therefore consists of a vacuum-distillation residuum of an atmospheric-distillation residuum of a Safaniya crude petroleum. Its characteristics are given in Example 1. Feedstock $C_2$ consists of an atmospheric-distillation residuum of a Maya crude petroleum.

The characteristics of this feedstock are as follows:

| | |
|---|---|
| Density at 15° C.: (Determined in conformity with standard AFNOR NFT 60-101) | 1026 $kg/m^3$ |
| Viscosity at 100° C.: (Determined in conformity with standard AFNOR NFT 60-100) | 876 $mm^2/s$ |
| Conradson residue: (Determined in conformity with standard AFNOR NFT 60-116) | 19.7 wt. % |
| Asphaltene content: (Determined in conformity with standard AFNOR NFT 60-115) | 16.2 wt. % |
| Sulfur content: (Determined by x-ray fluorescence) | 4.57 wt. % |
| Nickel content: (Determined by x-ray fluorescence) | 91 ppm |
| Vanadium content: (Determined by x-ray fluorescence) | 480 ppm |

These feedstocks are subjected to:

deasphalting control tests $T_3$ (with $C_1$) and $T_4$ (with $C_2$) without prior shearing of the feedstock, and tests $A_3$ (with $C_1$) and $A_4$ (with $C_2$) in accordance with the process of the invention after prior shearing of the feedstock, with addition of solvent prior to shearing.

The addition of solvent, n-heptane, is made with agitation at a temperature 10° C. higher than the softening temperature of the feedstock: 60° C. for $C_1$, and 34° C. for $C_2$ (determined in conformity with standard AFNOR NFT 66-008).

Shearing is effected at a temperature of 95° C. in a turbine having a gap of 0.6 mm and a notched head (with the teeth spaced 2 mm apart) at a speed of rotation of 17,000 rpm.

For the tests $T_3$ and $A_3$, a solvent composed of 89 weight percent n-pentane and 11 weight percent n-heptane is used.

For the tests $T_4$ and $A_4$, the solvent contains 78.1 weight percent n-pentane and 21.9 weight percent n-heptane.

In these compositions, allowance is made for the n-heptane previously added.

The conditions of the tests are given in Table 3 below.

TABLE 3

| Test | Temperature, °C. | Pressure, pascals abs | Mass ratio solvent to feedstock |
|---|---|---|---|
| $T_3$ | 175 | $4 \cdot 10^6$ | 3 |
| $A_3$ | 175 | $4 \cdot 10^6$ | 3 |
| $T_4$ | 175 | $4 \cdot 10^6$ | 3 |
| $A_4$ | 175 | $4 \cdot 10^6$ | 3 |

At the end of these tests and after separation of the solvent, an oil phase and an asphaltic phase are obtained. The yields obtained and the characteristics of these phases are determined. They are presented in Table 4 which follows.

TABLE 4

| Test | | $T_3$ Oil phase | $T_3$ Asphaltic phase | $A_3$ Oil phase | $A_3$ Asphaltic phase | $T_4$ Oil phase | $T_4$ Asphaltic phase |
|---|---|---|---|---|---|---|---|
| Yield, wt. % | | 57.7 | 42.3 | 61.7 | 38.3 | 72.5 | 27.5 |
| Density at 15° C., $kg/m^3$ | (1) | 986 | | 984 | | 974 | |
| Index of refraction at 60° C. | | 1.5433 | | 1.544 | | 1.5362 | |
| Viscosity at 100° C., $mm^2/s$ | (4) | 200 | | 197.1 | | 59.5 | |
| Conradson residue, wt. % | (5) | 9.8 | 40.2 | 10.2 | 41.9 | 8.1 | 45.0 |
| Asphaltene content, wt. % | (6) | 1.82 | 51.3 | 1.60 | 62.7 | 3.8 | 70.8 |
| Sulfur content, wt. % | (7) | 4.14 | 7.00 | 4.03 | 7.2 | 3.74 | 6.94 |
| Nickel content, ppm | (7) | 7 | 117 | 7 | 104 | 15 | 262 |
| Vanadium content, ppm | (7) | 22 | 332 | 24 | 348 | 95 | 1299 |

| Test | | $A_4$ Oil phase | $A_4$ Asphaltic phase |
|---|---|---|---|
| Yield, wt. % | | 75.3 | 24.7 |
| Density at 15° C., $kg/m^3$ | (1) | 975 | |
| Index of refraction at 60° C. | | 1.5381 | |
| Viscosity at 100° C., $mm^2/s$ | (4) | 62.9 | |
| Conradson residue, wt. % | (5) | 7.8 | 45.7 |
| Asphaltene content, wt. % | (6) | 2.8 | 75.1 |
| Sulfuir content, wt. % | (7) | 3.73 | 7.03 |
| Nickel content, ppm | (7) | 15 | 248 |
| Vanadium content, ppm | (7) | 99 | 1310 |

(1) In conformity with standard AFNOR NFT 60-101
(4) In conformity with standard AFNOR NFT 60-100
(5) In conformity with standard AFNOR NFT 60-116
(6) In conformity with standard AFNOR NFT 60-115
(7) Determined by x-ray fluorescene The same conclusions may be drawn as with respect to Example 1.

What is claimed is:

1. A process for improving the deasphalting of a heavy hydrocarbon feedstock comprising a mixture of an oil phase and an asphaltic phase with a solvent, the process comprising subjecting the feedstock to a shearing at a rate of at least about $10^3 s^{-1}$ before or after the addition of at least a portion of the solvent to the feedstock and includes deasphalting the feedstock by solvent extraction.

2. The process of claim 1 wherein the shearing is caused by forced passage of the feedstock through at least one of a restriction, a convergent die, a gap, and a pipe of smaller cross-sectional area than the feed pipe for the feedstock.

3. The process of claim 1 wherein shearing is produced by an agitating means.

4. The process of claim 3 wherein the agitating means is a turbine.

5. The process of claim 1 wherein the shearing step occurs simultaneously with the deasphalting step such that the heavy hydrocarbon feedstock, containing light components, is separated by the addition of the solvent into a lighter oil phase and a heavier asphaltic phase wherein said asphaltic phase is precipitated and said light components contained in said feedstock are soluble in said solvent.

6. The process of claim 2 wherein the gap is bounded by a stationary element and a coaxial element rotating within the stationary element, said elements cooperating with the gap and with each other to produce shearing as the feedstock is forcibly passed through the gap.

7. The process of claim 6 wherein the shearing is at a rate is in the range from $10^3$ to $10^6 s^{-1}$.

8. The process of claim 7 wherein the shearing is at a rate is in the range from $10^4$ to $2\times10^5 s^{-1}$.

9. The process of claim 1, wherein the solvent utilized to deasphalt the feedstock is selected from the group consisting of:

(a) at least one saturated or unsaturated aliphatic hydrocarbon having from 2 to 8 carbon atoms;
(b) at least one hydrocarbon distillate having a molecular weight substantially the same as those of the hydrocarbons of paragraph (a), but not including the hydrocarbons of paragraph (a);
(c) a mixture of the hydrocarbons of paragraph (a) with the hydrocarbon distillate of paragraph (b);
(d) an oxygenated hydrocarbon compound; and
(e) mixtures of two or more ingredients from paragraph (a) through paragraph (d).

10. The process of claim 1 wherein the amount of solvent added to the feedstock is in a mass ratio of from 1 to 10.

11. The process of claim 1 wherein the process is carried out at a pressure in the range from $20\times10^5$ to $1\times10^7$ pascals absolute.

12. The process of claim 1 wherein the process is carried out at a temperature in the range from 30° to 300° C.

13. The process of claim 1 wherein the feedstock is subjected to the shearing prior to being contacted with any solvent.

14. The process of claim 1 wherein the said heavy hydrocarbon feedstock has a density at 15° C. greater than about 930 $kg/m^3$.

15. The process of claim 14 wherein the shearing is at a rate is in the range from $10^3$ to $10^6 s^{-1}$.

16. The process of claim 15 wherein the shearing is caused by forced passage of the feedstock through a gap which is bounded by a stationary element and a coaxial element rotating within the stationary element, said elements cooperating with the gap and with each other to produce shearing as the feedstock is forceably passed through the gap.

17. The process of claim 16 wherein the shearing step occurs simultaneously with the deasphalting step such that the heavy hydrocarbon feedstock, containing light components, is separated by the addition of the solvent into a lighter oil phase and a heavier asphaltic phase wherein said asphaltic phase is precipitated and said light components contained in said feedstock are soluble in said solvent.

18. The process of claim 1, wherein the solvent utilized to deasphalt the feedstock is selected from the group consisting of:

(a) at least one saturated or unsaturated aliphatic hydrocarbon having from 2 to 8 carbon atoms;
(b) at least one hydrocarbon distillate having a molecular weight substantially the same as those of the hydrocarbons of paragraph (a), but not including the hydrocarbons of paragraph (a);
(c) a mixture of the hydrocarbons of paragraph (a) with the hydrocarbon distillates of paragraph (b); and
(d) mixtures of two or more ingredients from paragraph (a) through paragraph (c);

wherein the amount of solvent added to the feedstock is in a mass ratio of from 1 to 10;
wherein the process is carried out at a pressure in the range from $20\times10^5$ to $1\times10^7$ pascals absolute;
wherein the process is carried out at a temperature in the range from 30° to 300° C.; and
wherein the shearing is at a rate is in the range of from $10^4$ to $2\times10^5 s^{-1}$.

19. The process of claim 1, wherein the shearing occurs after addition of a portion of solvent and thereafter the sheared feedstock is deasphalted by solvent extraction.

20. A process for deasphalting a heavy hydrocarbon feedstock comprising a mixture of an oil phase and an asphaltic phase with at least one deasphalting solvent, the process comprising:

mixing the feedstock with an effective amount of at least one deasphalting solvent,
subjecting the feedstock to a shearing at a rate of at least about $10^3 s^{-1}$ before or after the addition of at least a portion of the solvent to the feedstock,
thereby forming a deasphalted oil phase and at least a precipitated asphaltene-containing phase,
thereafter separating the phases, and
then fractionating each phase to recover most of the solvent therefrom.

21. A process for improving the deasphalting of a heavy hydrocarbon feedstock comprising a mixture of an oil phase with a solvent, the process comprising subjecting the feedstock to a shearing at a rate of at least about $10^3 s^{-1}$ before addition of at least a portion of the solvent to the feedstock, which latter addition is part of deasphalting the feedstock by solvent extraction.

* * * * *